US005795211A

United States Patent [19]

Carignan et al.

[11] Patent Number: 5,795,211

[45] Date of Patent: Aug. 18, 1998

[54] ILLUMINATED NON-LATEX BALLOON

[75] Inventors: Robert Carignan, Cranston, R.I.; Chen Ping, Hong Kong, Hong Kong

[73] Assignee: Satellite Balloon Manufacturer of Hong Kong Ltd., Hong Kong, Hong Kong

[21] Appl. No.: 691,980

[22] Filed: Aug. 2, 1996

Related U.S. Application Data

[63] Continuation-in-part of Ser. No. 585,176, Jan. 11, 1996, abandoned.

[51] Int. Cl.[6] ..... A63H 3/06; A63H 33/26

[52] U.S. Cl. ..... 446/220; 446/485; 362/253; 362/267

[58] Field of Search ..... 362/253, 269; 446/220, 221, 222, 223, 224, 225, 226, 485

[56] References Cited

U.S. PATENT DOCUMENTS

| | | | |
|---|---|---|---|
| 1,530,923 | 3/1925 | Anna | 446/224 |
| 3,519,530 | 7/1970 | Struble . | |
| 3,592,157 | 7/1971 | Schwartz . | |
| 4,292,999 | 10/1981 | Scollmann . | |
| 4,363,081 | 12/1982 | Wilbur | 446/485 X |
| 4,393,284 | 7/1983 | Rivollet et al. | 446/485 X |
| 4,451,873 | 5/1984 | Tyler et al. | 362/267 |
| 4,542,445 | 9/1985 | Marletta | 446/224 X |
| 4,638,207 | 1/1987 | Radice | 446/220 X |
| 4,704,934 | 11/1987 | Nosrati | 446/220 X |
| 4,736,281 | 4/1988 | Neumeier . | |
| 4,776,589 | 10/1988 | Yang . | |
| 4,842,007 | 6/1989 | Kurtz | 446/220 X |
| 4,884,990 | 12/1989 | Lovik | 446/220 |
| 4,917,646 | 4/1990 | Kieves . | |
| 4,997,403 | 3/1991 | Akman | 446/220 |
| 5,066,011 | 11/1991 | Dykstra et al. | 446/485 X |
| 5,117,344 | 5/1992 | Perez | 362/253 X |
| 5,119,281 | 6/1992 | Akman . | |
| 5,183,329 | 2/1993 | Chen . | |
| 5,188,558 | 2/1993 | Barton et al. | 446/220 X |
| 5,228,686 | 7/1993 | Maleyko | 446/485 X |
| 5,282,768 | 2/1994 | Akman . | |
| 5,295,892 | 3/1994 | Felton | 446/224 |
| 5,405,479 | 4/1995 | Anderson . | |
| 5,464,354 | 11/1995 | Akman . | |

FOREIGN PATENT DOCUMENTS

| | | | |
|---|---|---|---|
| 156850 | 8/1932 | Switzerland | 446/220 |

*Primary Examiner*—Robert A. Hafer
*Assistant Examiner*—D. Neal Muir
*Attorney, Agent, or Firm*—Robert W.J. Usher

[57] ABSTRACT

An inflated non-latex, portable balloon has an internal lamp or transducer connected to an external battery. The balloon is made from an open-necked balloon body formed from panels of balloon material having inner polyethylene layers heat sealed together along peripheries. A pair of flat, metal conductor leads are hermetically sealed in polyethylene to extend in parallel to provide a discrete integral elongate, strip form lead member which is located extending through the open neck with one end supportingly connecting the lamp within the body. The balloon body is inflated and the neck hermetically sealed with the lead member by heat/pressure or ultrasonics thereby fusing together polyethylene surfaces of the lead member and the balloon panels to provide a hermetic seal; and, a battery is connected to ends of the leads outside the balloon.

21 Claims, 6 Drawing Sheets

FIG 3
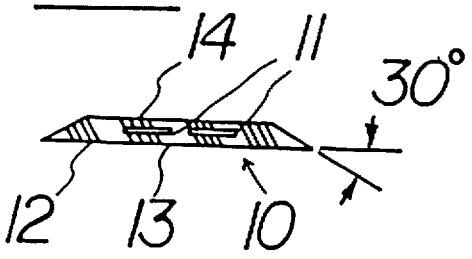
FIG 4
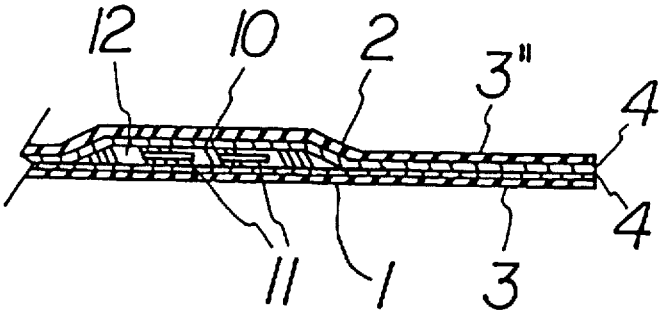
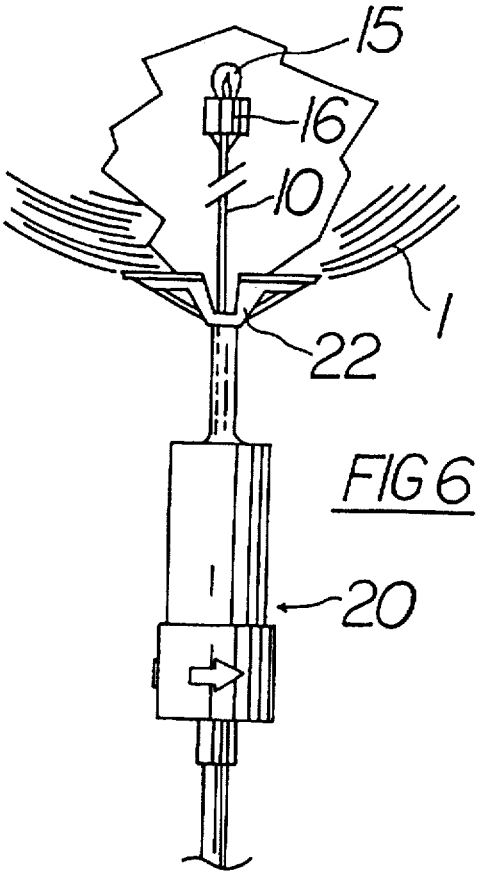
FIG 6

ILLUMINATED NON-LATEX BALLOON

RELATED APPLICATION

This is a continuation-in-part application of Ser. No. 08/585,176, filed Jan. 11, 1996 now abandoned.

FIELD OF THE INVENTION

The invention relates to non-latex inflatable portable articles and particularly, but not solely, to inflatable toys such as toy balloons.

BACKGROUND OF THE INVENTION

Non-latex portable balloons have been very widely used for many years for amusement, decoration, greetings and advertising purposes. The balloons are usually inflated with air when a support such as a carrying stick, is provided, to maintain such balloons aloft, and, with helium when unsupported to provide the required lift. Although provision is often made for reinflation, air filled balloons are usually desired or expected to remain inflated for several months or longer, while those filled with helium may have an expected inflated life of several weeks.

Examples of such balloons are found in U.S. Pat. No. 4,917,646 issued April, 1990 to Kieves, and in U.S. Pat. No. 5,405,479 issued Apr. 11, 1995 to Anderson the disclosures of which are incorporated herein by reference.

In order to provide the required durability, inflation life and to facilitate decorative printing, balloons are made of a non-latex plastic material. The balloon body is formed by two panels of such material having respective inner polyethylene containing layers heat sealed together around the perimeters. Such material is often a laminate including an inner, sealing layer of polyethylene laminated (or calendered) with an outer layer of, for example, ethylene vinyl alcohol copolymer (e.g. laminate sold under the trade name EVAL) where a completely clear, see-through, characteristic is required, (e.g front panel) or with an outer layer of nylon, where metalization (e.g. aluminum) for opacity or reflection is required, e.g. back panel).

As an additional attraction, it has often been proposed to house electrically powered devices such as lamps within the inflated balloons but problems have been experienced in providing an effective, gas tight seal between electric leads extending between the devices and external power sources, such as batteries.

One approach taught by U.S. Pat. No. 5,183,329, issued Feb. 2, 1993 to Chen, utilizes an electric coupler having an elastomeric sealing plug through which connecting pins pass and carried by a body having a peripheral flange heat sealed to the balloon material. However, that is a relatively complex and expensive multipart construction.

Any solution must be relatively simple so that the balloons can be manufactured at low cost and at high volume by conventional mass production techniques for a broad spectrum of consumers, including children. When the balloon is to be inflated with helium, the structure should also be of light weight to maintain good lift.

The seal must be such as to retain air without appreciable loss for at least six months or more and with helium without appreciable loss thereof to be commercially viable.

The problem is particularly pronounced with helium filled balloons as the helium molecules diffuse through the sealing area relatively quickly as a result of their small size.

Initial attempts by the present inventors to use conventional PVC coated wire soldered to LED and heat sealed or glued to the polyethylene laminate were not successful in providing an effective seal because of incompatibility of PVC with the polyethylene. Even if the heat sealing appeared, on visual inspection, to be satisfactory, gas still leaked out through the neck of the balloon. Although heat-sealing the bare round wire directly to the polyethylene laminate seemed to be possible, such approach was found to be impractical for economic mass production as requiring an unacceptably long time to position the bared wires correctly to attain a seal while the perfect seal required to retain gas in the balloon for a satisfactory period was not easily achieved. It was concluded that, in general, the bare round wire will not provide an effective hermetic or gas-tight seal with the laminate as it was possible to move the wires in the sealing area by pulling them. Therefore, the approach of heat sealing the bared wires directly to the laminate was rejected in view of the problems of handling and quality control.

Further attempts involving a first step of adhering, with liquid polyethylene as a glue, individual bared round and then flat wires directly to the polyethylene and subsequently applying heat to seal the panel necks together about the wires so enveloped by the glue provided a satisfactory seal but the handling time was still unacceptable for cost effective mass production.

SUMMARY OF THE INVENTION

It is an object of the invention to overcome the above mentioned disadvantage by providing a substantially gas tight seal between the polyethylene layer and the electric leads extending between an internal electrical device and an external power source in a cost effective manner and which can be substantially completely assembled in the factory, using conventional mass production techniques.

According to the invention, individual flat, metal conductors of lead pairs are enveloped with polyethylene to form a discrete, unitary lead member which is then bonded or fused by the application of heat or ultrasound to the polyethylene layers of the balloon material.

The provision of the unitary lead member obviates the problems of handling individual conductors while providing a structure in which the conductors are hermetically sealed and which is also compatible for hermetic or gas-tight heat sealing with the balloon material by using a heat sealing approach of the conventional balloon production lines.

More particularly, the individual conductors may be flat or ribbon-like copper conductors completely embedded or covered by polyethylene by extrusion or, in-molding, in polyethylene or between two strips of polyethylene heat sealed together.

This process can be completed in the factory essentially during or after the conventional step of heat sealing the body panels of the balloon together with the LED or other electric device enclosed therebetween. It is merely necessary for the free ends of the leads to be pulled out through the usual preformed inflation slit and crimped, soldered or otherwise permanently connected to an external power source.

BRIEF DESCRIPTION OF THE DRAWINGS

In order that the invention may be readily understood, specific embodiments thereof will now be described with reference to the accompanying drawings in which:

FIG. 3 is an enlarged cross-sectional view of an extruded lead member taken along line A—A of FIG. 2;

FIG. 4 is an enlarged cross-sectional view taken along line B—B of FIG. 2;

FIG. 6 is a schematic fragmentary perspective view of the balloon mounted on the carrying stick;

DESCRIPTION OF PARTICULAR EMBODIMENTS

Figure 1:
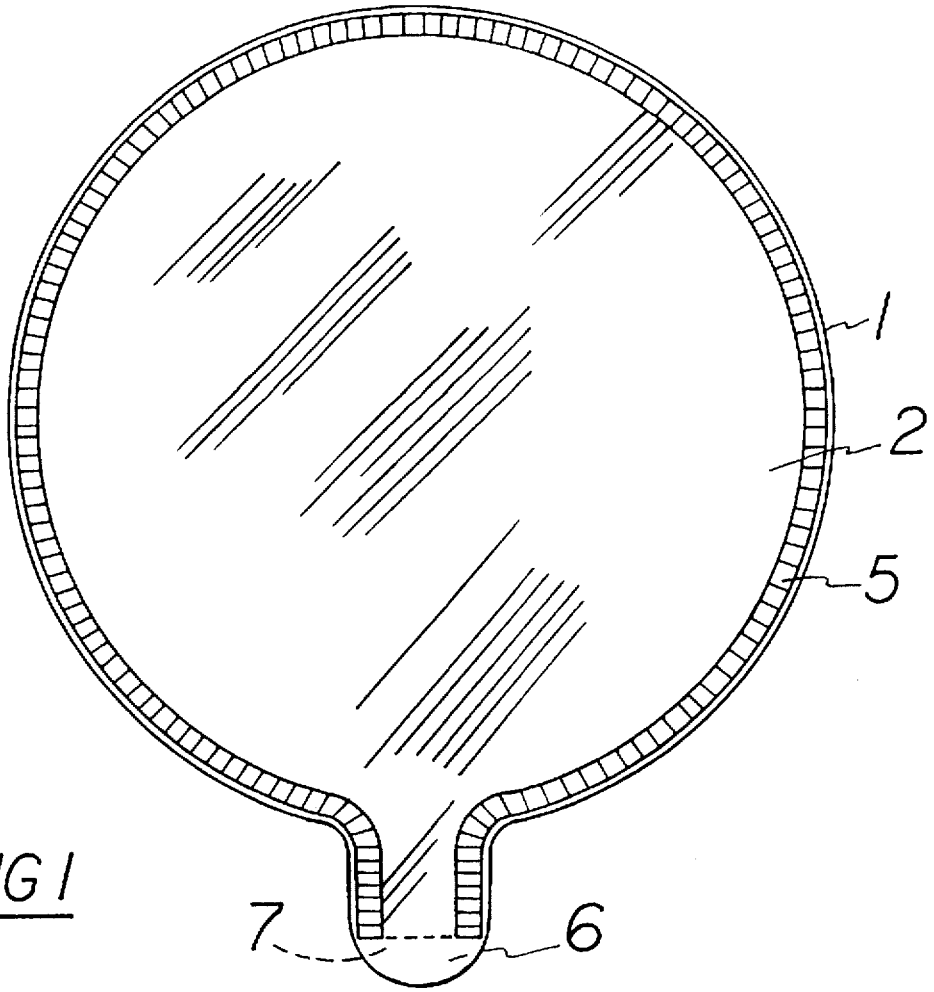
FIG. 1 is a schematic plan view of a first embodiment of a balloon for support by a carrying stick at a first stage of manufacture showing front and back panels sealed together at their peripheries, prior to inflation.

As shown in FIG. 1, the non-latex plastic film balloon body comprises front and rear panels 1 and 2, respectively, formed from sheets of balloon laminate material consisting respectively of an outer layer of ethylene vinyl alcohol copolymer 3 (EVOH), and an outer, aluminum plated, nylon layer 3' both laminated (calendered) with inner polyethylene layer 4, (in the latter case, 12 microns nylon, 17 microns polyethylene). The respective inner polyethylene layers 4, are heat sealed together around their entire peripheries 5 except at an end of a neck or stem 6 so that respective EVOH and aluminum plated, nylon layers 3' are outermost (see FIG. 4). A transverse severance or slit 7 is formed across the neck to provide an access opening. The laminate of the clear front panel, formed by layers of polyethylene and EVOH, is sold under the trade name EVAL.

As shown in FIGS. 2–6, a semi-rigid lead member 10 consists of an elongate body of trapezoid cross-section formed by embedding a pair of ribbon like copper conductors 11 in polyethylene 12 by extrusion. The lower major surface 13 of the lead member 10 is flat, while the upper surface 14 is tapered towards respective elongate edges for engagement by resilient, upper and rigid, flat lower dies during the step of heat sealing in the neck of the balloon, as described further below.

A lamp 15 of the type disclosed in U.S. Pat. No. 5,119,281 issued June 1992 to Akman is supportingly connected by housing 16 to one end of the lead member 10.

The clear front panel 1 of the balloon body enables the lamp light to be viewed therethrough (or, alternatively, decorated, leaving a transparent window aligned with the lamp 15 and the back panel 2 made reflective and printed with decorative artwork).

Figure 5:
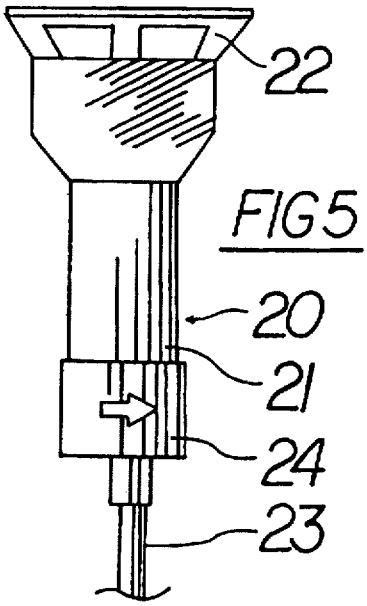
FIG. 5 is a perspective view of a combination battery housing and carrying stick.

A combination battery housing and carrying stick 20, shown in FIGS. 5 and 6 comprises a molded, plastic battery-receiving casing 21 having a balloon supporting cup portion 22 at an upper end and an extruded tubular carrying stick 23 depending from a lower end. A conventional on/off mechanism is actuable by a rotary sleeve 24 on the casing 21.

In manufacture, upper and lower webs of balloon laminate are heat sealed together at a die station to define the balloon body, as shown in FIG. 1, the severance 7 being cut either before or after panel sealing. The lead member 10 carrying the connected lamp is then inserted into the balloon through the severance or slit 7 so that the lamp 15 is aligned with the transparent window, if provided. The balloon is inflated with air and the neck 6 of the balloon then sealed about the lead member 10 at 26 by placement between lower heated, flat, rigid and upper, resilient dies at the inflation station so that the respective abutting polyethylene surfaces 12, 4 of the lead member 10 and balloon panels 1, 2 are fused together to establish a substantially air-tight bond between the lead member 10 and the inner polyethylene layers 4 of the balloon material, as shown in FIG. 4.

The exposed free ends 27 of the copper leads 11 are then connected by soldering, crimping or other conventional technique to contacts (not shown) of the combination hand held battery housing and carrying stick 20.

The balloon according to this embodiment may, in normal use, be expected to remain inflated for at least six months.

Figure 7:
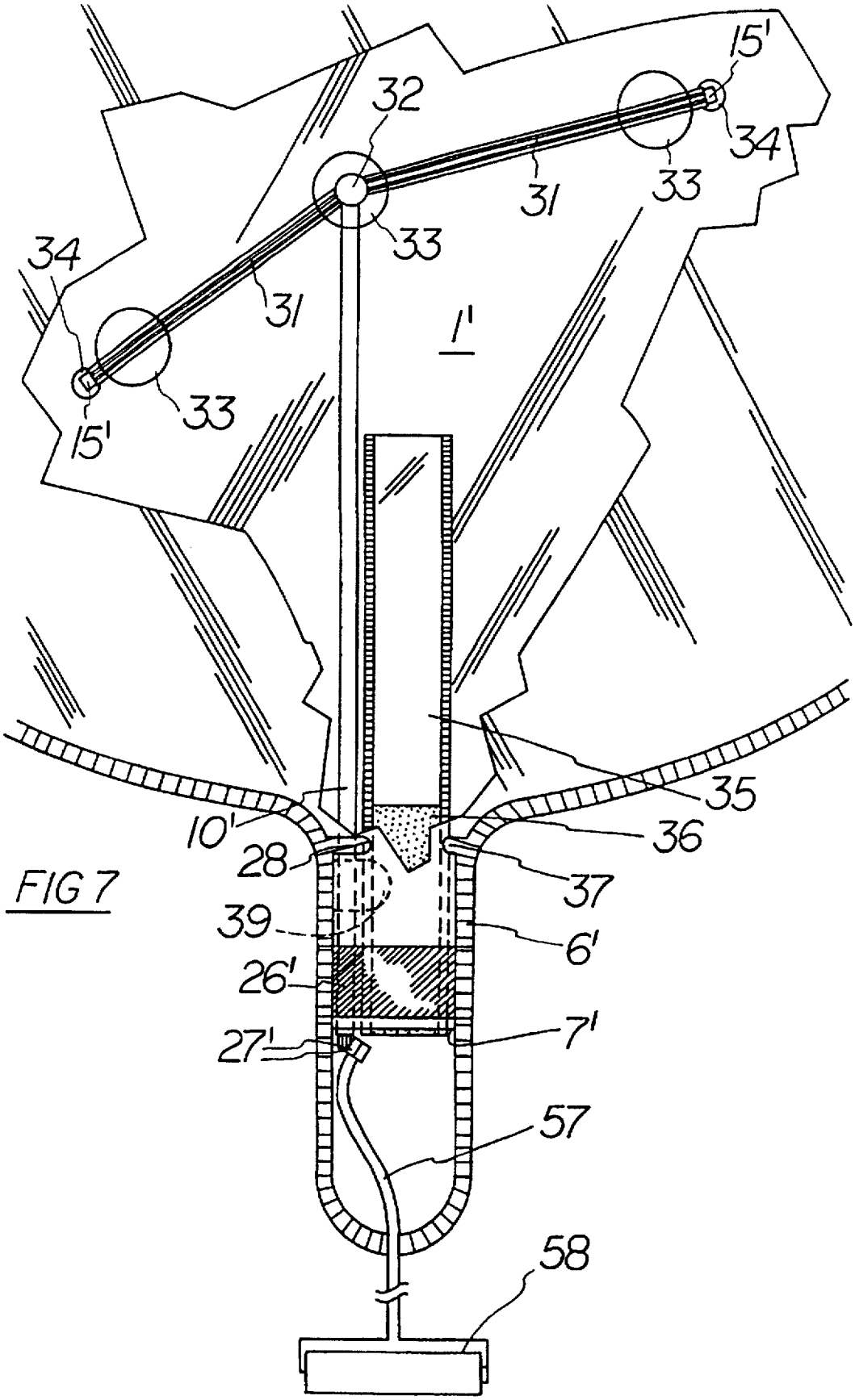
FIG. 7 is a schematic fragmentary view of a second embodiment of balloon for inflation with helium.

The second embodiment of balloon shown in FIG. 7, is designed to be inflated with helium at the point of sale to the end user. In view of the similar construction to the first embodiment, similar elements will be designated with primed reference numerals.

Figure 8:
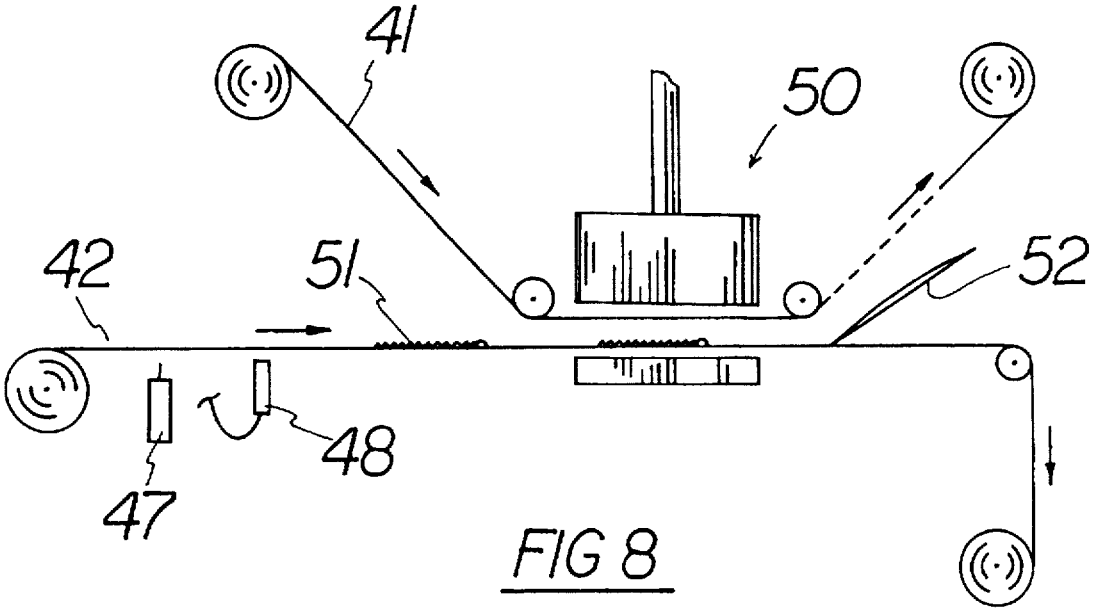
FIG. 8 is a schematic view of an assembly line for the second embodiment.
Figure 2:
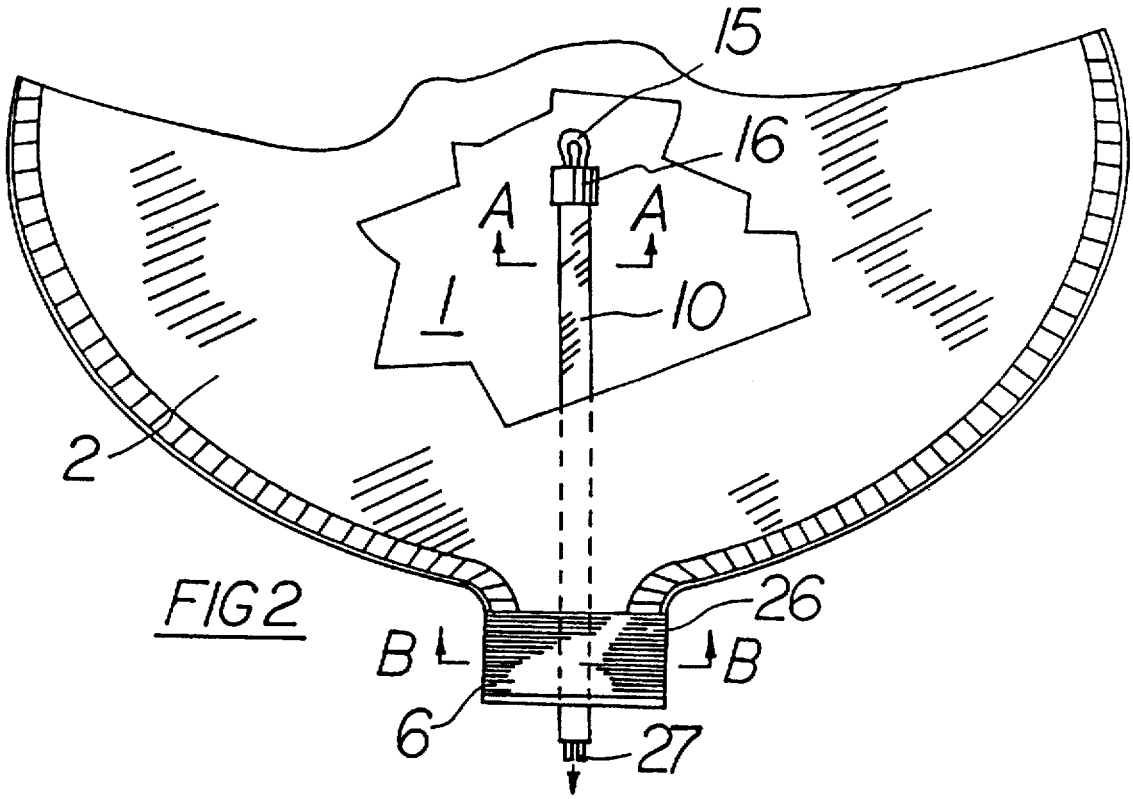
FIG. 2 is a schematic fragmentary view of the inflated balloon ready for connection to an external battery and carrying or display stick.

As in the first embodiment, a lead member 10' comprises flat copper wires surrounded by polyethylene, heat sealed at two spaced apart locations 26', 28 in a neck 6', 28 designating a tack weld. However, while the extrusion technique would be feasible, as the balloon and, in particular, lamps thereof are not requiring support, the lead member 10' can be flexible and manufactured by heat sealing two strips of polyethylene about the conductor pair (which may, conceivably, also each be strips of a metal foil such as aluminum, reducing weight). The lead member can then be sealed in a balloon neck at a sealing temperature of 140–180 degrees C. Several light emitting diodes 15' are connected to leads 31 extending from a connector 32 on one end of the lead member 10' and secured to the inner surface of a front balloon panel 1' by portions of adhesive tape 33 so as to be aligned with a series of transparent windows 34. A conventional self sealing, inflation valve 35 made of polyethylene sheet and of the known type described as prior art in FIG. 7A of U.S. Pat. No. 4,917,646 is also heat sealed in the neck 6'. It will be noted that the portion of the interior of the valve which is located in the neck is coated with heat resistant ink 36 to maintain the valve open after a neck heat sealing step. An access slot 7' is formed in the neck prior to the step of heat sealing the front and rear panels together. The manufacturing steps are illustrated in FIG. 8 in which upper and lower sheets or webs 41, 42, respectively, of preprinted balloon material are fed by rollers past operating stations comprising a lower slitting station 47 for cutting the slit 7' in the lower web 42, a sensor or electric eye 48 for detection of the correct position indicated by alignment indicia, for example, printed on the lower web 42, and a heat sealing and cutting die station 50. The lower web 42 also has the balloon outline indicated thereon and alignment arrows for accurate placement of tapes, diodes etc.

Initially, a sub-assembly 51 of the diodes, associated flexible cable, lead member and valve are secured by portions of adhesive tape 33, 39 in the correct positions shown in FIG. 7 on the lower web 42 (corresponding to the front panel of the balloon) and both upper and lower sheets fed to the die station. The slit 7' is formed in the lower web 42 at a location approximately one quarter of an inch above the ends of the lead and valve members at the slitting station 47 during passage therethrough. The body of the balloon is then defined by shaping and sealing together upper and lower panels around the peripheries, forming tack welds 28, 37 which further secure the valve and lead member in position forming a balloon subassembly 52 which is then removed from the assembly line and passed to another neck sealing station having upper, resilient and lower rigid, flat, heated dies where the polyethylene layers of the balloon material are fused or welded to the polyethylene of the valve and lead member to provide a substantially gas tight seal at 26'.

Subsequently, in the factory, the ends of the valve and lead member are brought out through the slit 7' so that the conductors 27' can be crimped, soldered or otherwise connected to leads 57 of a battery housing 58 or for connection at the time of sale in a store to an end consumer when filling with helium, to a connector (not shown). The leads 57 can be secured in the factory to the top surface of the neck of the balloon by adhesive tape.

Figure 12:
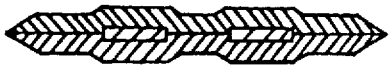
FIG. 12 is a cross-sectional view similar to FIG. 4 of an alternative lead member.

The lead member shown in FIG. 12, for example, may be continuously manufactured by feeding two flat wires in spaced apart parallel relation from storage reels between upper and lower polyethylene strips also fed from respective storage reels and heat sealing the strips together about the flat wires between upper and lower, suitably profiled, roller nips.

Figure 9:
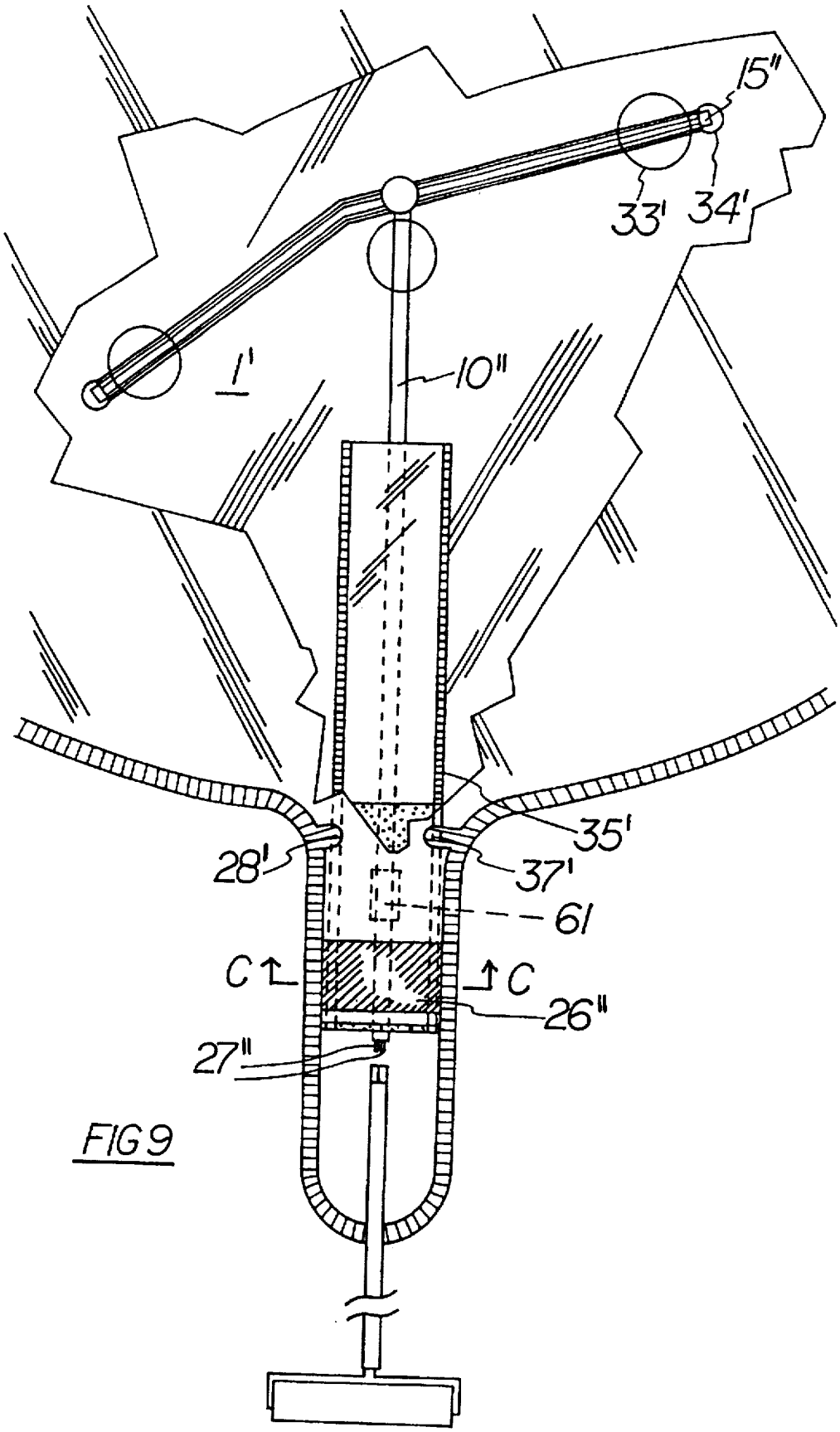
FIG. 9 is a schematic fragmentary view of a third embodiment of balloon for inflation with helium.
Figure 10:
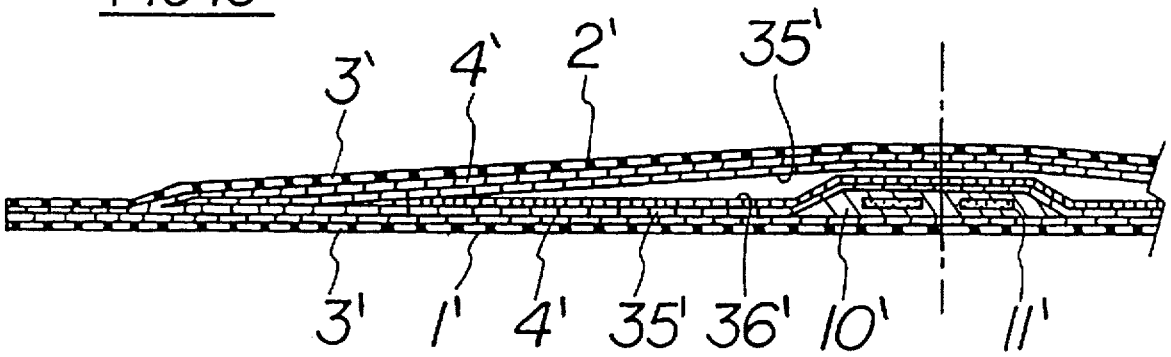
FIG. 10 is an enlarged cross-sectional view taken along line C—C of FIG. 9.
Figure 11:
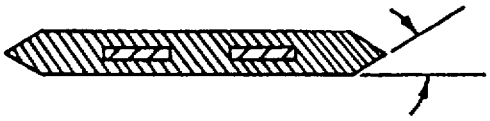
FIG. 11 is a cross-sectional view similar to FIG. 3 of a lead member having convex opposite faces to provide an advantageous double taper.

In a third embodiment shown in FIG. 9, the lead member is preassembled with the valve member by heat sealing to a central location of the exterior of one sheet thereof as indicated at 61 so that they form a single unit or sub assembly for securement to the lower sheet (corresponding to the front panel). The valve is oriented so that it bends away from the lead member when the balloon is inflated. The sub assembly is secured by tack welds 28' and 37' to the front panel at the die station 50 in similar fashion to the second embodiment. At the neck sealing station, the upper and lower faces of the lead member 10" are fused or welded to the inner polyethylene layers of the front face and of the valve 35', respectively, while an opposite polyethylene layer of the valve is fused or welded to the inner polyethylene layer of the rear face 2" as shown in FIG. 10 to create the gas tight seal.

In another embodiment of balloon, optical fibers transmit light from a light source such as a lamp or light emitting diode mounted within the balloon body.

In a further embodiment, the transducers are sound generators, for example, audio speakers for playing birthday songs.

The inside plastic surface of the back panel can be printed with a solid color leaving discrete reflective areas of the metalization defining hearts or other desired shapes exposed to view through the clear front panel.

Alternatively, both the front and rear panels of the helium filled balloons of the second and third embodiments may also be clear and made of EVOH laminated with polyethylene without metalization. Whilst the EVOH/polyethylene laminate is believed to provide the most clarity or transparency, it is believed that a nylon/polyethylene laminate without metalization could also be used for the front panel where a diffuse or translucent effect is sought.

We claim:

1. A method for producing an inflated non-latex, portable balloon with an internal lamp having an external electric power source comprising the steps of:

forming a balloon body with an open neck by providing first and second panels of balloon material having respective inner polyethylene layers and sealing the layers together along respective peripheries by one of heat/pressure and ultrasonic vibration;

enveloping a pair of flat metal conductor leads in polyethylene to provide a discrete integral elongate, strip to form a lead member with the leads in hermetically sealed relation, extending spaced apart between opposite longitudinal ends thereof;

electrically connecting an electric lamp to the leads at one end of the lead member so that the electric lamp is supported thereby;

inflating the balloon body with air;

sealing the neck closed, substantially airtight, with the lead member extending therethrough with the electric lamp inside the balloon and opposite ends of the leads outside the balloon by application of one of heat/pressure and ultrasonic vibration to the neck thereby fusing together polyethylene surfaces of the lead member and the balloon panels to provide a hermetic seal; and, electrically connecting a power source to the leads outside the balloon.

2. A method according to claim 1 wherein the lead member is semi-rigid thereby to support the lamp inside the balloon body.

3. A method according to claim 1 including the step of attaching the lamp to a panel prior to the step of forming the balloon body.

4. A method according to claim 1 wherein the polyethylene is extruded aorund the conductor leads thereby enveloping the conductor leads.

5. A method according to claim 1 wherein the lead member tapers toward respective opposite longitudinal edges forming a substantially biconvex cross-section for sealing engagement by resilient sealing dies.

6. A method according to claim 1 wherein the lead member has a generally trapezoidal transverse cross-section formed by a first, flat major face and a second, opposite major face which inclines toward respective opposite longitudinal edges for sealing engagement by flat, rigid and resilient sealing dies, respectively.

7. A method according to claim 1 wherein the conductor leads are enveloped in polyethylene by providing a pair of strips of polyethylene and hermetically sealing the polyethylene strips therearound by application of one of heat sealing and ultrasonic welding.

8. A method according to claim 1 wherein the conductor leads are enveloped in polyethylene by in-molding.

9. A method according to claim 1 including the step of electrically connecting an external power source to the exposed leads by one of crimping and soldering.

10. A method for producing a non-latex, portable balloon comprising the steps of:

forming a balloon body with an open neck by providing first and second panels of balloon material having respective inner polyethylene layers and sealing the layers together along respective peripheries;

enveloping a pair of metal conductor leads in polyethylene to provide an elongate, strip form lead member with the leads extending spaced apart between opposite longitudinal ends thereof, the lead member having a generally trapezoidal transverse cross-section formed by a first, flat major face and a second, opposite major face which inclines toward respective opposite longitudinal edges for sealing engagement by flat, rigid and resilient sealing dies, respectively;

electrically connecting an electrical transducer to the leads at one end of the lead member so that the transducer is supported thereby;

inflating the balloon body with air;

sealing the neck closed, substantially airtight, with the lead member extending therethrough with the transducer inside the balloon and opposite ends of the leads outside the balloon by application of one of heat/pressure and ultrasonic vibration to the neck thereby fusing together polyethylene surfaces of the lead member and the balloon panels; and, electrically connecting a power source to the leads outside the balloon.

11. A method for producing a non-latex, portable balloon for inflation with helium comprising the steps of:

providing upper and lower sheets of balloon material having respective inner polyethylene layers in face to face relation;

enveloping a pair of flat metal conductor leads in polyethylene to provide an unitary elongate strip form lead member with the leads extending in gas-tight relation spaced apart from each other between opposite longitudinal ends thereof;

electrically connecting at least one electrical transducer to the leads at one, inner end of the lead member;

providing a tubular inflation valve of polyethylene with a heat resistant lining;

forming a severance in the lower sheet at a location extending transversely across a precursor of a balloon neck;

anchoring said at least one transducer and the lead member and the inflation valve to predetermined locations on the inner layer of the lower sheet corresponding to an interior of a front face of a balloon body for said at least one transducer and an interior neck portion of the balloon for the lead member and the inflation valve with inner ends of the lead member and valve in a location corresponding to the balloon body and outer ends of the valve and lead member extending a small distance beyond the severance;

forming a sealed balloon body with a neck by providing first and second panels of balloon material having respective inner polyethylene layers and heat sealing the layers together along respective peripheries so that the severance provides an access opening in the neck;

sealing the neck closed, substantially gastight by application of heat and pressure to the neck thereby fusing together polyethylene surfaces of the lead member, valve and the balloon panels;

drawing free ends of the lead member and valve through the slot out from the neck to expose the leads for connection to an external power source and to expose the outer end of the valve for connection to a helium inflation source.

12. A method according to claim 11 including the step of fusing the lead member and valve to the neck at predetermined locations for anchoring thereof during the step of forming the balloon body.

13. A method according to claim 11 including the step of electrically connecting an external power source receptacle to the exposed leads by one of crimping and soldering.

14. A method according to claim 11 wherein the said at least one transducer is at least one light emitting diode.

15. A balloon according to claim 11 wherein the transducers are sound generators.

16. A method for producing a non-latex, portable balloon for inflation with helium comprising the steps of:

providing upper and lower sheets of balloon material having respective inner polyethylene layers in face to face relation;

enveloping a pair of flat, metal conductor leads in polyethylene to provide an unitary elongate strip form lead member with the leads extending in gas-tight relation spaced apart from each other between opposite longitudinal ends thereof;

electrically connecting at least one electrical transducer to the leads at one, inner end of the lead member;

providing a tubular inflation valve of polyethylene with a heat resistant lining;

attaching the lead member to an outside surface of the valve to form a unit by fusing the polyethylene of the lead member and valve together by one of heat sealing and ultrasonic welding;

electrically connecting at least one transducer to the leads at one, inner end of the lead member;

forming a severance in the lower sheet at a location extending transversely across a precursor of a balloon neck;

anchoring said at least one transducer and the unit to predetermined locations on the inner layer of the lower sheet corresponding to an interior of a front face of a balloon body for said at least one transducer and an interior neck portion of the balloon for the unit with inner ends of the lead member and valve in a location corresponding to the balloon body and outer ends of the valve and lead member extending a small distance beyond the severance;

forming a sealed balloon body with a neck by providing first and second panels of balloon material having respective inner polyethylene layers and heat sealing the layers together along respective peripheries so that the severance provides an access opening in the neck;

sealing the neck closed, substantially gastight by application of heat and pressure to the neck thereby fusing together engaging polyethylene surfaces of the lead member, valve and the balloon panels;

drawing free ends of the lead member and valve through the slot out from the neck to expose the leads for connection to an external power source and to expose the outer end of the valve for connection to a helium inflation source.

17. A method according to claim 16 including the step of fusing the unit to the neck at predetermined locations for anchoring thereof during the step of forming the balloon body.

18. A balloon according to claim 17 wherein the leads are connected to an external power source by one of soldering and crimping.

19. A balloon according to claim 17 wherein the power source is enclosed by a housing attached to a carrying stick.

20. A method according to claim 16 wherein the said at least one transducer is at least one light emitting diode.

21. A balloon according to claim 16 wherein the transducers are sound generators.

* * * * *